United States Patent [19]

Assaf et al.

[11] 4,446,025

[45] May 1, 1984

[54] METHOD OF AND APPARATUS FOR PRE-TREATING MAKE-UP WATER CONTAMINATED WITH NUTRIENTS

[75] Inventors: Gad Assaf, Rehovot; Yehuda Cohen, Elat, both of Israel

[73] Assignee: Solmat Systems Ltd., Yavne, Israel

[21] Appl. No.: 361,112

[22] Filed: Mar. 23, 1982

[51] Int. Cl.[3] ..... C02F 3/32; F24J 3/02

[52] U.S. Cl. ..... 210/602; 119/2; 126/415; 210/747; 210/170

[58] Field of Search ..... 119/2; 210/602, 747, 210/170; 126/415, 452

[56] References Cited

U.S. PATENT DOCUMENTS

| | | | |
|---|---|---|---|
| 3,916,832 | 11/1975 | Sweeney | 119/2 |
| 4,171,681 | 10/1979 | Berger et al. | 119/2 X |
| 4,249,480 | 2/1981 | Dugan et al. | 119/2 |
| 4,345,581 | 8/1982 | Shacher | 210/170 X |

OTHER PUBLICATIONS

Dimentman, Chanan; Distribution and Biology of *Artemia salina* (L.) (Crustacia: Anostraca in Israel and the Sinai Peninsula; Israel Journal of Zoology; May 1981; Plus Attachment pp. 28–37.

Dimentman, H.; Distribution and Biology of *Artemia salina* in Israel and Sinai (In Hebrew with English Translation Attached), Hebrew Version Distributed at Zoological Association Meeting in BeerSheva, Israel, about Oct. 8, 1979.

*Primary Examiner*—Thomas G. Wyse

*Attorney, Agent, or Firm*—Sandler & Greenblum

[57] ABSTRACT

Make-up water contaminated with nutrients is pre-treated by establishing a stagnant pond of brackish water having an upper wind-mixed layer exposed to solar radiation and of relatively low, uniform salinity, an intermediate halocline whose salinity increases monotonically with depth, and a lower collection layer of relatively high, uniform salinity. Make-up water contaminated with nutrients is added to the wind-mixed layer wherein the nutrients support the growth of photosynthetic microbes. The wind-mixed layer is provided with *Artemia salina* (brine shrimp) that feed on the photosynthetic microbes growing in the wind-mixed layer and extrude fecal pellets of a density in excess of the density of at least the upper layer of the pond, whereby the pellets sink below the wind-mixed layer, and preferably to the collection layer. Upward diffusion from the collection layer into the wind-mixed layer of the disintegrated constituents of the fecal pellets is suppressed by reason of the stratified nature of the halocline. In this way, the brine shrimp clear the wind-mixed layer of nutrients.

19 Claims, 1 Drawing Figure

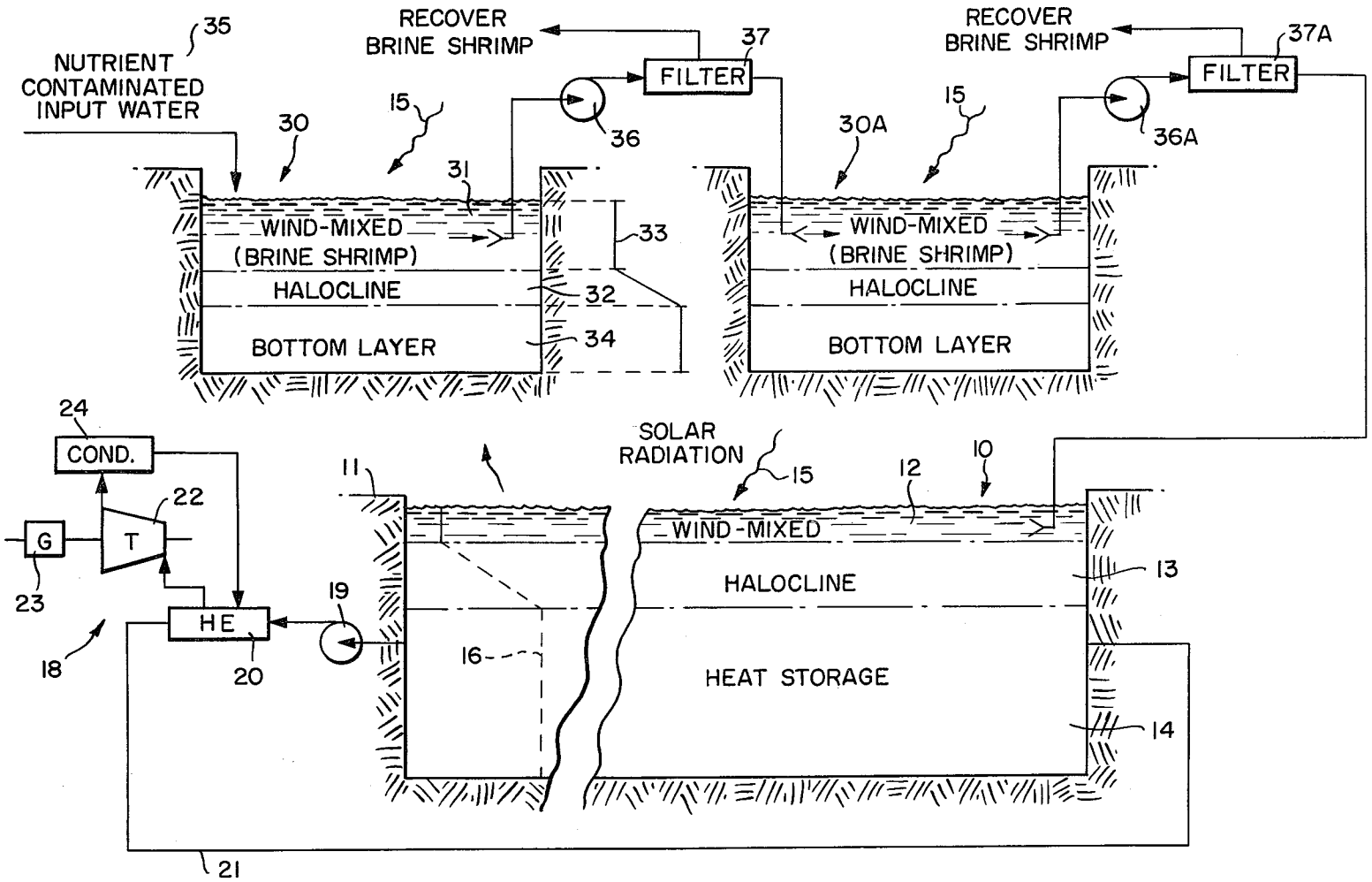
37A
FILTER
36A
RECOVER
BRINE SHRIMP
15
30A
WIND-MIXED
(BRINE SHRIMP)
HALOCLINE
BOTTOM LAYER
37
FILTER
36
RECOVER
BRINE SHRIMP
33
32
34
31
15
30
WIND-MIXED
(BRINE SHRIMP)
HALOCLINE
BOTTOM LAYER
35
NUTRIENT
CONTAMINATED
INPUT WATER
13
14
10
12
15
WIND-MIXED
HALOCLINE
HEAT STORAGE
SOLAR
RADIATION
16
11
19
20
HE
21
22
T
24
COND.
G
23
18

METHOD OF AND APPARATUS FOR PRE-TREATING MAKE-UP WATER CONTAMINATED WITH NUTRIENTS

DESCRIPTION

TECHNICAL FIELD

This invention relates to a method of and apparatus for pre-treating make-up water contaminated with nutrients, and is particularly useful for, although not necessarily limited to, use with artificial solar ponds.

BACKGROUND ART

An artificial solar pond is a man-made body of standing water designed to collect solar radiation and store heat over a relatively long period of time. It has a multilayer regime: a wind-mixed layer at the surface of the pond, a halocline below the wind-mixed layer, a heat storage layer below the halocline, and a thermocline at the bottom of the pond. The wind-mixed layer has a depth from 10–50 cm depending on weather conditions and has a uniform salinity from 3–5%. The halocline is from 1–1.5 m deep and has a salinity profile that increases monotonically with depth to a salt concentration of about 25–30%. Usually the heat storage layer is of uniform salinity and has a depth adequate to provide the amount of heat storage required. Finally, the thermocline is a stratified layer usually of uniform salinity at the bottom of the pond.

The wind-mixed layer is convective and its temperature approximates ambient temperature. The halocline is non-convective by reason of its density gradient with the result that solar radiation absorbed within the halocline heats the halocline and sets up a temperature gradient matching the density gradient. Heat from the halocline is transfered to the underlying heat storage layer by conduction across the interface between the halocline and the heat storage layer. The halocline thus acts as an active insulator for the heat storage layer preventing cooling by conductive heat transfer to the ambient atmosphere above the wind-mixed layer. The heat storage layer is convective by reason of the mixing of the layer due to the transfer of heat from the heat storage layer for useful purposes, and will be of a substantially uniform temperature. The lowermost layer in the pond is the thermocline which is stratified and serves as an insulator against conductive cooling of the heat storage layer to the ground below the pond.

Heat can be extracted from the heat storage layer by placing a heat exchanger within the heat storage layer and pumping a heat exchange fluid through the heat exchanger. Usually, the heat exchange fluid will be an organic working fluid such as Freon which is vaporized in the heat exchanger and then expanded in a turbine producing work. The exhausted vapor from the turbine is then condensed and returned to the heat exchanger which acts as a boiler for the turbine. Alternatively, heated water from the heat storage layer can be pumped to a heat exchanger external to the pond and then returned to the heat storage layer.

At latitudes corresponding to Southern California, Arizona, and New Mexico in the United States, the average solar input, the year round, day and night, is about 250 Watts/m$^2$. A solar pond is about 20% effecient in converting this energy into heat with the result that the average heat input to the heat storage layer of a pond situated at the indicated latitude is about 50 Watts/m$^2$. On an annual basis, the solar power input to the heat storage is about 400 KWhr/m$^2$. Thus, in one year, a one acre pond will store the heat equivalent of about 1.6 mKWhr. If the water temperature of the heat storage layer is about 80 degrees Celsius, the heat storage layer will have to be about 2 meters deep.

When a solar pond is located in an arid environment where fresh water is scarce, water to construct the pond or to compensate for evaporation losses after the pond is in use may be made available by constructing catch basins to collect run-off water that normally would be dissipated. Such run-off water originates from limited rainfall in the area of the solar pond, or from the discharge of irrigation pipelines. As a consequence of flow over the ground and into the catch basins, the run-off water is contaminated with nutrients such as phosphates and nitrates. Using water so contaminated to construct a pond will present a favorable environment for the growth of photosynthetic microbes that exhibit halophilism, i.e., microbes that demand salt for growth and maintenance. The level of salt present in a given layer in the pond will determine the type of halobacteria that can grow. For example, halophilic algae, molds, and amebae will grow in the moderately saline environment of the wind-mixed layer and in that portion of the halocline in a solar pond which does not exceed 50° C. Particularly when the water in the pond is rich in nutrients, the growth of *Dunaliella viridis, Dunaliella salina*, and other Dunaliella spp. will be encouraged. Blooms of these halophilic materials in the upper portions of the pond causes turbidity which will reduce light transmission into the halocline and thus decrease the ability of the pond to absorb useful solar radiation that can be transfered to the heat storage layer.

In principle, blooms of algae can be controlled by the addition to the pond of herbicides or poisonous metallic salts such as copper sulphate. This conventional approach to controlling algae growth, however, requires periodic checking of the concentration of the anti-algae materials in the pond. Another disadvantage of the conventional approach to controlling algae lies in the environmental impact of poisonous materials in a large body of water.

It is, therefore, an object of the present invention to provide a new and improved method of and apparatus for controlling the turbidity in a body of brackish water without the use of herbicides or poisonous salts.

DISCLOSURE OF INVENTION

In accordance with the present invention, a method for pre-treating make-up water contaminated with nutrients includes establishing a stagnant pond of brackish water having a wind-mixed layer exposed to solar radiation and of relatively low, uniform salinity, and intermediate halocline whose salinity increases monotonically with depth, and a lower collection layer of relatively high, uniform salinity. The make-up water is added to the wind-mixed layer, where the nutrients support the growth of photosynthetic microbes. According to the present invention, the wind-mixed layer is provided with aquatic life that feeds on the photosynthetic microbes, which themselves feed on the nutrients, and produces fecal pellets of a density greater than the density of the upper and intermediate layers of the pond. Such pellets sink into the collection layer from which upward diffusion of disintegrated constituents of the pellets is suppressed by reason of the stratified nature of the halocline.

Preferably, the aquatic life is *artemia salina* or brine shrimp. These creatures are relatively small, from 1–1.5 cm in length, and gather organic material such as algae or plankton, and detritus (i.e., loose material such as sand particles or organic particles) suspended in the wind-mixed layer and ingest such material. The legs of a brine shrimp direct the organic material and detritus into its gut tract, where digestion occurs.

The metabolism of brine shrimp is very large, with the result that approximately 90% of the organic material ingested by the brine shrimp is burned up, and only about 10% becomes part of the waste material, which is encapsulated in a fecal pellet and then extruded into the water. The fecal pellets are of the order of magnitude of several millimeters, and have a density in excess of the density of the water in which the brine shrimp swim. As a consequence, the fecal pellets sink through the halocline to the collection layer. After a period of time, the fecal pellets disintegrate; but diffusion of the disintegrated components is suppressed by reason of the stratified nature of the halocline. Consequently, nutrients in the wind-mixed layer provide nourishment for photosynthetic microbes which eliminate the nutrients; and the microbes provide food for the brine shrimp. Waste material from the brine shrimp, by reason of its encapsulation in relatively dense fecal pellets, settles from the wind-mixed layer, which is thus cleared of the nutrients and any foreign material.

When this pre-treatment is carried out in batch form, the wind-mixed layer will eventually become free of nutrients, and may be drained off and delivered to a utilization device, such as a solar pond, by merely pumping the wind-mixed layer through a filter which separates any entrained brine shrimp. Because of the difference in density between the wind-mixed layer and the halocline, separation of these layers is easily accomplished.

The water from which the nutrients have been removed can then be used as make-up water for an existing solar pond in order to compensate for evaporation losses in the pond. The absence of nutrients in the solar pond will inhibit growths that cause turbidity and reduce the ability of the pond to efficiently collect solar radiation. Alternatively, the water can be used for other purposes, which would be precluded were the nutrients still present.

In an alternative arrangement, a series of stagnant ponds could be utilized to remove the nutrients step-by-step on a continuous basis rather than on a batch basis.

BRIEF DESCRIPTION OF DRAWING

An embodiment of the invention is shown in the single FIGURE of the accompanying drawing, which shows a sequential pre-treatment of make-up water contaminated with nutrients before the water is added to a solar pond to compensate for evaporation losses.

DETAILED DESCRIPTION

Referring now to the drawing, reference numeral 10 designates a utilization device for pre-treated water in the form of an artificial solar pond contained within embankments 11. Pond 10 comprises wind-mixed layer 12 at the surface of the pond, halocline 13 below the wind-mixed layer, and heat storage layer 14 below the halocline. In a relatively deep solar pond, a thermocline (not shown) is established at the bottom of the pond.

The wind-mixed layer has a depth in the range 10–50 cm, depending on weather conditions, and has a uniform salinity in the range 3–5%. The halocline has a thickness in the range 1–1.5 m, and has a salinity profile that increases montonically with depth, as indicated by salinity curve 16 to a salt concentration in the range of 25–30%. Usually, the heat storage layer 14 is of uniform salinity, as indicated by curve 16, and has a depth adequate to provide the required heat storage capacity.

The wind-mixed layer is convective, and its temperature approximates ambient temperature. The halocline is non-convective by reason of its inverse density gradient, with a result that solar radiation 15 absorbed in the halocline heats the halocline and sets up a temperature gradient that closely matches salinity gradient 16. Heat from the halocline is transferred to the underlying heat storage layer by conduction across the interface between the halocline and the heat storage layer.

Heat is extracted from the heat storage layer by pumping liquid from the heat storage layer into a heat exchanger located external to the pond, and then returning the cooled brine to the pond. As indicated in the drawing, power plant 18 associated with the pond operates on the principle described above. That is to say, heat from the heat storage layer is pumped via pump 19 into heat exchanger 20 located external to the pond, and then returned through piping 21 to the heat storage layer at a point which is isolated from the intake point supplying brine to pump 19.

A heat exchange liquid, usually an organic working fluid such as Freon, in the heat exchanger is vaporized and passes into turbine 22, where the vapors expand, turning the turbine and driving generator 23, which produces electricity. Exhaust vapor from the turbine is condensed at 24 and returned to the heat exchanger, which thus acts as a boiler for the power plant.

The water making up the pond into which salt is usually dissolved for the purpose of creating the halocline and the heat storage layer will usually be locally available water, which is usually rich in nutrients such as phosphates and nitrates. In addition, make-up water must be provided in order to maintain the level of the pond in the face of evaporation of the wind-mixed layer. The make-up water, particularly in arid environments, can be obtained by constructing catch basins to collect runoff water during the rainy season, or overflow from irrigation systems. Because of its contact with the ground, the run-off water will be contaminated with nutrients, and it is these nutrients that cause problems with the pond. As a consequence, in the absence of the pre-treatment, at least the wind-mixed layer and possibly the entire pond will be rich in nutrients, and will be a repository for wind-carried detritus. In addition to the turbidity caused by floating particles, the stagnant nature of the pond represents a favorable environment for the growth of photosynthetic microbes that exhibit halophilism. Specifically, blooms of *Dunaliella viridis, Dunaliella salina*, and other Dunaliella spp. can be expected to occur in the pond, creating turbidity which will decrease the ability of the pond to absorb heat, and thus decrease the ability of the pond to replace heat used by power plant 18.

For pre-treating the make-up water contaminated with nutrients before the water is added to the wind-mixed layer, stagnant ponds 30 and 30A are utilized. While two stagnant ponds are shown in series, only one may be used, or more than two may be used, depending upon the particular circumstances such as whether batch or continuous treatment is involved, the amount of nutrients in the water, and the speed with which the nutrients must be removed with regard to the rate at which treated make-up water is to be furnished to wind-mixed layer 12 of pond 10. Each stagnant pond is similar, so that only pond 30 will be described in detail.

Pond 30 is of brackish water having upper wind-mixed layer 31 about 0.5–1.0 m deep exposed to solar radiation 15, and having a relatively low, uniform salinity as indicated by curve 33, which is the salinity profile taken through pond 30. Beneath the wind-mixed layer is an intermediate layer about 0.2 m deep in the form of halocline 32, whose salinity increases with depth as indicated by curve 30 to a level of about 25–30%. The bottom or collection layer 34, which is from 0.5–1.0 m deep, lies beneath the halocline, and it has a relatively high, uniform salinity. Upper wind-mixed layer 31 is created by adding nutrient-contaminated input water, as indicated at 35, to pond 30, such input such as water resulting, for example, from storage in catch basins. The nutrients in wind-mixed layer 31 support the growth of photosynthetic microbes of the type described above due to the interaction of solar radiation 15 and the nutrients contained in the water.

Also provided in the wind-mixed layer are *artemia salina* (brine shrimp). The moderate salinity of the wind-mixed layer is a favorable environment for the brine shrimp, which feed on any algae or plankton and detritus present in the wind-mixed layer. Brine shrimp, in effect, filter the water in the wind-mixed layer as they feed. Leg movement of the brine shrimp draws water through filtering bracts, which collect solids in the water and move them into its gut tract. The brine shrimp swallows not only its foodstuffs, but all floating particles up to a dimension that is dependent on the size of the brine shrimp. The metabolism of brine shrimp is very large, with the result that approximately 90% of the ingested organic material is burned up, and only about 10% becomes part of the waste material. Material ingested by movement of the legs of the brine shrimp is digested; and the residue is encapsulated in fecal pellets which are then extruded into the water. Inorganic particles, such as sand grains and the like, which cannot be digested, are also passed into the waste material excreted by the brine shrimp.

The fecal pellets are of the order of magnitude of several millimeters, and have a density in excess of the density of the water in the wind-mixed layer and the density in most of the halocline. As a consequence, the fecal pellets sink into the collection layer and to the bottom of the pond. The brine shrimp thus act to remove not only organic, but inorganic material as well, from the wind-mixed layer and serve as an active filter which eventually clears the wind-mixed layer.

Because a brine shrimp may eat ¼ of its weight in an hour, the brine shrimp population in a pond serves to rapidly sweep organic material and sand particles from the water. A small portion of the organic material and all of the inorganic material thus collected is extracted from the wind-mixed layer by the brine shrimp and collected into pellets, which sink to the bottom of the pond, thus removing both organic and inorganic material from the wind-mixed layer.

Once the fecal pellets have sunk below the halocline, the constituent parts of the pellets, which will disintegrate in time, remain trapped in the bottom layer. This situation arises because diffusion across the halocline is very small.

If a single stagnant pond 30 is utilized, for batch treating make-up water, the water in the wind-mixed layer is not transferred to solar pond 10 until substantially all of the nutrients have been removed. When the situation warrants, however, a continuous treatment process may be followed; and in such case, pond 30A is utilized. Water from the wind-mixed layer in pond 30 may be transferred continuously to the wind-mixed layer of pond 30A as the water from the latter is continuously transferred to the wind-mixed layer 12 of solar pond 10. While a gravity-feed arrangement may be utilized, the drawing shows pump 36 for removing water from wind-mixed layer 31, diffuser 17 serving to minimize perturbations to the halocline which, as is well known, exhibits long-term stability. Water removed by pump 36 passes through filter 37 before being transferred via a diffuser to the wind-mixed layer of pond 30A. Filter 37 removes any brine shrimp entrained in the water pumped by pump 36, and can be used to harvest the brine shrimp for transfer back into the wind-mixed layer of pond 30A or for removal from the system. Brine shrimp have a commercial value as fish food, and provide a useful by-product of the water treatment process of the present invention.

The second stage of treatment for removing nutrients from make-up water for pond 10 is carried out in pond 30A. In this case, pump 36A pumps water from the wind-mixed layer of pond 30A through filter 37A before delivering the water through a diffuser into the wind-mixed layer of pond 10. Filter 37A functions to recover the brine shrimp for harvesting purposes or for return to the wind-mixed layer.

The invention described above is also applicable to pre-treating water used in constructing a solar pond, as well as treating make-up water to replace evaporation losses. In other words, the present invention could be utilized to treat water before it is added to the solar pond during its construction in order to insure that the pond will be free of nutrients that support microbial growths. In such case, therefore, a series of stagnant ponds like that shown by reference numeral 30 can be established using run-off water collected in catch basins until a sufficient amount of water has been cleared of nutrients for filling pond 10. Alternatively, water from an existing pond can be treated using stagnant ponds as shown by reference numeral 30 in order to clear the water in the natural pond of nutrients that have been deposited there by run-off water and by other means. In either event, the nutrients from the water used to establish the wind-mixed layer of the solar pond are removed before the water is added to the solar pond.

It is believed that the advantages and improved results furnished by the method and apparatus of the present invention are apparent from the foregoing description of the preferred embodiment of the invention. Various changes and modifications may be made without departing from the spirit and scope of the invention as described in the claims that follow.

What is claimed is:

1. A method for reducing nutrients in brackish water contaminated with nutrients comprising:

(a) establishing a three-layer stagnant pond having an upper, convective wind-mixed layer exposed to solar radiation and of relatively low, uniform salinity, an intermediate stratified, non-convective halocline whose salinity increases monotonically with depth, and a lower collection layer of relatively high, uniform salinity;

(b) adding the brackish water to the wind-mixed layer wherein the nutrients support the growth of photosynthetic microbes;

(c) providing, in the wind-mixed layer, aquatic life that feeds on said microbes and produce fecal pellets of a density in excess of the density of at least the upper layer of the pond, whereby such pellets sink to a level below the upper layer, from which upward diffusion is suppressed by reason of the stratified nature of the halocline; and (d) using the water in the wind-mixed layer as make-up water in a ultilization device that requires nutrient free water.

2. A method according to claim 1 wherein the aquatic life is *artemia salina.*

3. A method according to claim 2 including the step of controlling the population of *artemia salina* by periodically removing some from the wind-mixed layer.

4. A method according to claim 3 wherein the population is controlled by pumping water from the wind-mixed layer through a filter and collecting the *artemia salina* at the filter.

5. A system for pre-treating make-up water comprising the method of claim 1, and including the step of establishing a second three layer stagnant pond like the first-mentioned pond and sequentially treating the brackish water by passing it through both ponds.

6. A method according to claim 1 wherein the utilization device is an artificial salt water solar pond.

7. Apparatus for reducing nutrients in brackish water contaminated with nutrients comprising:

(a) a three layer stagnant pond having an upper, convective wind-mixed layer exposed to solar radiation and of relatively low, uniform salinity, an intermediate, stratified, non-convective halocline whose salinity increases monotonically with depth, and a lower collection layer of relatively high, uniform salinity;

(b) means for adding the brackish water to the wind-mixed layer wherein the nutrients support the growth of photosynthetic microbes;

(c) aquatic life in the wind-mixed layer which feeds on said microbes and produces fecal pellets of a density in excess of the density of at least the upper layer of the pond, whereby such pellets sink to a level below the upper layer, from which upward diffusion is suppressed by reason of the stratified nature of the halocline;

(d) a utilization device requiring nutrient-free make-up water; and (e) means for adding water from the wind-mixed layer of the stagnant pond to the utilization device.

8. Apparatus according to claim 7 wherein the aquatic life is *artemia salina.*

9. Apparatus according to claim 8 wherein said means for adding water includes means for removing water and *artemia salina* entrained therein from the wind-mixed layer and filter means for filtering water removed from the wind-mixed layer to separate entrained *artemia salina.*

10. Apparatus according to claim 9 including means for returning water passed by the filter means to the wind-mixed layer.

11. Apparatus according to claim 10 including means for returning water passed by the filter means to the solar pond.

12. A system including at least two ponds as defined in claim 7 wherein the aquatic life is *artemia salina,* means for removing water including *artemia salina* entrained therewith from the wind-mixed layer of the first pond, filter means for filtering water removed from the wind-mixed layer to separate entrained *artemia salina,* and means for returning water passed by the filter means to the wind-mixed layer of the second pond.

13. A system according to claim 12 wherein at least some of the *artemia salina* are returned to the first pond.

14. A system according to claim 7 wherein the utilization device is an artifical salt water solar pond.

15. Apparatus according to claim 7 wherein said utilization device is an artifical solar pond.

16. A method for constructing and operating an artifical solar pond of the type having a wind-mixed layer exposed to solar radiation at the surface of the pond and of relatively low, uniform salinity, a halocline below the wind-mixed layer having a salinity that increases monotonically with depth, and a heat storage layer below the halocline of relatively high, uniform salinity, the method comprising removing nutrients from the water used to establish the wind-mixed layer before the water is added to the solar pond.

17. A method according to claim 16 comprising collecting and storing run-off water in a region adjacent the pond, removing nutrients from the run-off water, and replacing water lost by evaporation from the pond with run-off water from which nutrients have been removed.

18. A method according to claim 17 wherein nutrients are removed by the following process:

(a) establishing a stagnant pond of brackish water having a wind-mixed layer exposed to solar radiation and of relatively low, uniform salinity, an intermediate halocline whose salinity increases monotonically with depth, and a lower collection layer of relatively high, uniform salinity;

(b) adding the make-up water to the wind-mixed layer wherein the nutrients support the growth of photosynthetic microbes; and (c) providing, in the wind-mixed layer, aquatic life that feeds on said microbes and produce fecal pellets of a density in excess of the density of at least the upper layer of the pond, whereby such pellets sink to a level below the upper layer, from which upward diffusion is suppressed by reason of the stratified nature of the halocline.

19. A method according to claim 18 wherein the aquatic life is *artemia salina.*

* * * * *